US009651049B2

(12) United States Patent
Hayashi et al.

(10) Patent No.: US 9,651,049 B2
(45) Date of Patent: May 16, 2017

(54) COMPRESSOR

(71) Applicant: DAIKIN INDUSTRIES, LTD., Osaka-shi, Osaka (JP)

(72) Inventors: Takeo Hayashi, Kusatsu (JP); Naoto Tomioka, Kusatsu (JP); Keiji Komori, Kusatsu (JP); Hiroki Kamiishida, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/033,060

(22) PCT Filed: Oct. 31, 2014

(86) PCT No.: PCT/JP2014/079139

§ 371 (c)(1),
(2) Date: Apr. 28, 2016

(87) PCT Pub. No.: WO2015/064759

PCT Pub. Date: May 7, 2015

(65) Prior Publication Data

US 2016/0252094 A1 Sep. 1, 2016

(30) Foreign Application Priority Data

Nov. 1, 2013 (JP) ..... 2013-228394

(51) Int. Cl.
*F16K 15/16* (2006.01)
*F04C 29/12* (2006.01)
(Continued)

(52) U.S. Cl.
CPC ..... *F04C 29/128* (2013.01); *F04B 39/1073* (2013.01); *F04C 18/0215* (2013.01);
(Continued)

(58) Field of Classification Search
CPC .. F04C 29/128; F04C 18/0215; F04C 18/322; F04C 23/008; F04C 29/065; F04B 39/1073; Y10T 137/7891; Y10T 137/7892
See application file for complete search history.

(56) References Cited

U.S. PATENT DOCUMENTS 4,730,996 A 3/1988 Akatsuchi et al.
4,886,093 A * 12/1989 Itakura ..... F04B 53/06 137/855
(Continued)

FOREIGN PATENT DOCUMENTS

CN 101072945 A 11/2007
JP 61-103072 A 5/1986
(Continued)

OTHER PUBLICATIONS

Supplementary European Search Report for EP14857340 dated Aug. 19, 2016.*
(Continued)

*Primary Examiner* — Jessica Cahill
(74) *Attorney, Agent, or Firm* — Global IP Counselors, LLP

(57) ABSTRACT

A compressor includes a member with a recess in which a reed discharge valve is disposed. The recess has a discharge hole, a fixation hole, and an annular projection formed around the discharge hole. The discharge valve includes a fixed portion, a flexible portion, and a head portion to open/close the annular projection. A protruding portion is formed at a rear end portion of the fixed portion. A first side surface of the protruding portion is designed to be substantially flush with a side surface of the fixed portion, which surface is closer to a center of the member. When the discharge valve rotates in a predetermined direction about the fixation hole after the discharge valve is disposed in the
(Continued)

recess but before being fixed to the member, the first side surface of the protruding portion comes into contact with a side wall of the recess.

8 Claims, 11 Drawing Sheets

(51) Int. Cl.

| | |
|---|---|
| ***F04C 23/00*** | (2006.01) |
| ***F04C 18/02*** | (2006.01) |
| ***F04C 18/32*** | (2006.01) |
| ***F04B 39/10*** | (2006.01) |
| ***F04C 29/06*** | (2006.01) |

(52) U.S. Cl.
CPC ..... *F04C 18/322* (2013.01); *F04C 23/008* (2013.01); *F04C 29/065* (2013.01); *Y10T 137/7891* (2015.04)

(56) References Cited

U.S. PATENT DOCUMENTS

| | | | | |
|---|---|---|---|---|
| 5,176,170 | A * | 1/1993 | Boyesen | F01L 3/205 123/65 V |
| 5,601,118 | A * | 2/1997 | Jang | F04C 29/128 137/856 |
| 5,775,887 | A * | 7/1998 | Park | F04B 39/1073 137/856 |
| 6,006,785 | A * | 12/1999 | Iversen | F04B 39/1073 137/855 |
| 6,309,194 | B1 * | 10/2001 | Fraser | F04B 39/1073 137/246 |
| 6,679,688 | B2 * | 1/2004 | Sato | F04B 39/1073 137/856 |
| 6,820,644 | B1 * | 11/2004 | François | F04B 39/1073 137/512 |
| 2005/0047947 | A1 * | 3/2005 | McCombs | F04B 35/04 417/545 |
| 2007/0148025 | A1 * | 6/2007 | Higashi | F04B 39/1073 417/559 |
| 2008/0113538 | A1 | 5/2008 | Masuda | |
| 2012/0060683 | A1 * | 3/2012 | Peters | F04C 18/3442 91/468 |
| 2015/0030484 | A1 * | 1/2015 | Rosa | F16K 15/144 417/559 |

FOREIGN PATENT DOCUMENTS

| | | | |
|---|---|---|---|
| JP | 2-227569 | A | 9/1990 |
| JP | 8-219057 | A | 8/1996 |
| JP | 2835063 | B2 | 10/1998 |
| JP | 2002-242862 | A | 8/2002 |
| JP | 2008-180143 | A | 8/2008 |
| JP | 2010-236564 | A | 10/2010 |
| JP | 2011-1830 | A | 1/2011 |

OTHER PUBLICATIONS

European Search Report dated Aug. 31, 2016 for EP14857340.*
International Search Report of corresponding PCT Application No. PCT/JP2014/079139 dated Jan. 27, 2015.
International Preliminary Report of corresponding PCT Application No. PCT/JP2014/079139 dated May 12, 2016.

* cited by examiner

COMPRESSOR

CROSS-REFERENCE TO RELATED APPLICATIONS

This U.S. National stage application claims priority under 35 U.S.C. §119(a) to Japanese Patent Application No. 2013-228394, filed in Japan on Nov. 1, 2013, the entire contents of which are hereby incorporated herein by reference.

TECHNICAL FIELD

The present invention relates to: a compressor such as a rotary compressor used in, for example, an air conditioner.

BACKGROUND ART

A known rotary compressor includes an end surface member of a cylinder, and the end surface member has a discharge hole opening to the inside of the cylinder. The compressor further includes a discharge valve and a valve limiting member which are provided in a recess of the end surface member. The discharge valve is configured to open/close the discharge hole of the end surface member. The valve limiting member cooperates with the end surface member so that the discharge valve is sandwiched between the valve limiting member and the end surface member. The valve limiting member and the discharge valve each has a through hole through which a rivet is inserted. With this rivet, the discharge valve is fixed while being sandwiched between the end surface member and the valve limiting member. The discharge valve includes a fixed portion, a flexible portion, and a head portion. The fixed portion is fixed to the end surface member. The flexible portion extends from the fixed portion. The head portion is located on a leading end side of the flexible portion and is configured to open/close the discharge hole.

CITATION LIST

Patent Literature

SUMMARY

Technical Problem

When the discharge valve is fixed to the end surface member in the known rotary compressor, the discharge valve may rotate to be shifted due to assembling backlash. Specifically, it is conceivable that after the discharge valve is disposed in the recess of the end surface member, the discharge valve rotates to be shifted within the range between: a position where a part of the discharge valve comes into contact with a side wall of the recess as a result of rotation in one direction about the fixed portion; and a position where another part of the discharge valve comes into contact with the side wall of the recess as a result of rotation in another direction. If the discharge valve thus shifted is fixed and therefore the head portion of the discharge valve is not able to properly close the discharge hole, the refrigerant may be reversed to cause a problem, of a reduction of compression efficiency. In particular, when the diameter of the compressor is downsized or the discharge hole has an oval shape, the length of the recess of the end surface member is shortened, and this increases the possibility that the discharge valve rotates to be shifted. Such a problem can occur also in a scroll compressor to which a discharge valve is attached, or a relief valve is attached, for example.

In view of the above, an object of the present invention is to provide a compressor in which shifting of a discharge valve due to assembling backlash is restricted.

Solution to Problem

According to the first aspect of the invention, the compressor includes a member disposed in proximity to a compression chamber and including a recess in which a discharge valve of a reed valve type is disposed, the recess being on a surface of the member which surface is on an opposite side from the compression chamber, wherein: in the recess, a discharge hole communicating with the compression chamber, a fixation hole used for fixing the discharge valve, and an annular projection formed around the discharge hole are provided; the discharge valve includes a fixed portion fixed to the member through the fixation hole, a flexible portion extending from the fixed portion, and a head portion located on a leading end side of the flexible portion and configured to open/close the annular projection; the fixed portion includes a protruding portion formed at its rear end portion; a first side surface of the protruding portion is designed to be substantially flush with a side surface of the fixed portion; and when the discharge valve rotates in a predetermined direction about the fixation hole after the discharge valve is disposed in the recess but before fixed to the member, the first side surface of the protruding portion comes into contact with a side wall of the recess.

In this compressor, the fixed portion includes, at its rear end portion, the protruding portion designed to be substantially flush with the side surface of the fixed portion which surface is on a side closer to a bearing portion. Further, when the discharge valve rotates in the predetermined direction about the fixation hole after the discharge valve is disposed in the recess but before fixed to the end surface member, the first side surface of the protruding portion comes into contact with the side wall of the recess. This restricts the discharge valve from, rotating and shifting in the predetermined direction. Thus, it is possible to avoid the situation where the head portion of the discharge valve fails to properly close the annular projection.

According to the second aspect, the compressor of the first aspect is arranged such that the recess is outlined along a rear end portion of the fixed portion; and when the discharge valve rotates in a direction opposite to the predetermined direction about the fixation hole after the discharge valve is disposed in the recess but before fixed to the end surface member, a second side surface of the protruding portion comes into contact with the side wall of the recess.

In this compressor, the recess is outlined along the rear end portion of the fixed portion. Further, when the discharge valve rotates in the other direction (the direction opposite to the predetermined direction) about the fixation hole after the discharge valve is disposed in the recess but before fixed to the end surface member, the second side surface of the protruding portion comes into contact with the side wall of the recess. This restricts the discharge valve from rotating and shifting in the other direction. Thus, it is possible to avoid the situation where the head portion of the discharge valve fails to properly close the annular projection.

According to the third aspect, the compressor of the first or second aspect is arranged such that the protruding portion has a rectangular shape in a plan view.

In this compressor, the protruding portion is designed to have a rectangular shape, and this effectively restricts the discharge valve from rotating and shifting in the other direction.

According to the fourth aspect, the compressor of any one of the first to third aspects is arranged such that the protruding portion is located in one of areas of the discharge valve divided by a center line of the discharge valve.

In this compressor, the protruding portion is located in one of the areas of the discharge valve divided by the center line of the discharge valve, and therefore the recess can be downsized as compared with the case where the protruding portion is located in an area across the width of the discharge valve. With this, in the case where a muffler main body is attached to an end surface of the end surface member, the area of the end surface of the end surface member sealed by the muffler main body is larger.

According to the fifth aspect, the compressor of any one of the first to fourth aspects is arranged such that a rear end portion of a side surface of the fixed portion which surface is not substantially flush with the protruding portion is designed to be curved in a plan view.

In this compressor, the rear end portion of the side surface of the fixed portion which surface is not substantially flush with the protruding portion is designed to be curved in a plan view. Therefore, when the discharge valve rotates in the predetermined direction to be shifted, it is possible to avoid the situation where the second side surface of the fixed portion of the discharge valve comes into contact with the side wall of the recess before the first side surface of the protruding portion of the discharge valve comes into contact with the side wall of the recess.

According to the sixth aspect, the compressor of the fifth aspect is arranged such that the discharge hole has an oval shape; and a length-wise direction of the discharge valve matches a longitudinal direction of the discharge hole.

If the discharge hole has an oval shape and the lengthwise direction of the discharge valve does not match the longitudinal direction of the discharge hole, a twist of the valve may occur at the time of opening/closing of the valve; however, this compressor, while preventing the reliability from being lessened due to such a twist, prevents shifting of the discharge valve even in the case where the length of the flexible portion, which contributes the rigidity of the valve, is ensured to some extent, though this shortens the fixed portion.

According to the seventh aspect, the compressor of any one of the first to sixth aspects is arranged such that the surface of the member on which the recess is formed faces a muffler space.

In this compressor, the area of the end surface of the end surface member sealed by the muffler main body is larger, and this prevents leakage of refrigerant from the muffler space.

Advantageous Effects of Invention

As described hereinabove, the present invention brings about the following effects.

In the first aspect, the fixed portion includes, at its rear-end portion, the protruding portion designed to be substantially flush with the side surface of the fixed portion which surface is on a side closer to a bearing portion. Further, when the discharge valve rotates in the predetermined direction about the fixation hole after the discharge valve is disposed in the recess but before fixed to the end surface member, the first side surface of the protruding portion comes into contact with the side wall of the recess. This restricts the discharge valve from, rotating and shifting in the predetermined direction. Thus, it is possible to avoid the situation where the head portion of the discharge valve fails to properly close the annular projection.

In the second aspect, the recess is outlined along the rear-end portion of the fixed portion. Further, when the discharge valve rotates in the other direction (the direction opposite to the predetermined direction) about the fixation hole after the discharge valve is disposed in the recess but before fixed to the end surface member, the second side surface of the protruding portion comes into contact with the side wall of the recess. This restricts the discharge valve from rotating and shifting in the other direction. Thus, it is possible to avoid the situation where the head portion of the discharge valve fails to properly close the annular projection.

In the third aspect, the protruding portion is designed to have a rectangular shape, and this effectively restricts the discharge valve from rotating and shifting in the other direction.

In the fourth aspect, the protruding portion is located in one of the areas of the discharge valve divided by the center line of the discharge valve, and therefore the recess can be downsized as compared with the case where the protruding portion is located in an area across the width of the discharge valve. With this, in the case where a muffler main body is attached to an end surface of the end surface member, the area of the end surface of the end surface member sealed by the muffler main body is larger.

In the fifth aspect, the rear end portion of the side surface of the fixed portion which surface is not substantially flush with the protruding portion is designed to be curved in a plan view. Therefore, when the discharge valve rotates in the predetermined direction to be shifted, it is possible to avoid the situation where the second side surface of the fixed portion of the discharge valve comes into contact with the side wall of the recess before the first side surface of the protruding portion of the discharge valve comes into contact with the side wall of the recess.

In the sixth aspect, the following advantages are provided. If the discharge hole has an oval shape and the lengthwise direction of the discharge valve does not match the longitudinal direction of the discharge hole, a twist of the valve may occur at the time of opening/closing of the valve; however, this compressor, while preventing the reliability from being lessened due to such a twist, prevents shifting of the discharge valve even in the case where the length of the flexible portion, which contributes the rigidity of the valve, is ensured to some extent, though this shortens the fixed portion.

In the seventh aspect, the area of the end surface of the end surface member sealed by the muffler main body is larger, and this prevents leakage of refrigerant from the muffler space.

DESCRIPTION OF EMBODIMENTS

The following will describe the invention in detail with reference to illustrated embodiments.

First Embodiment

Figure 1:
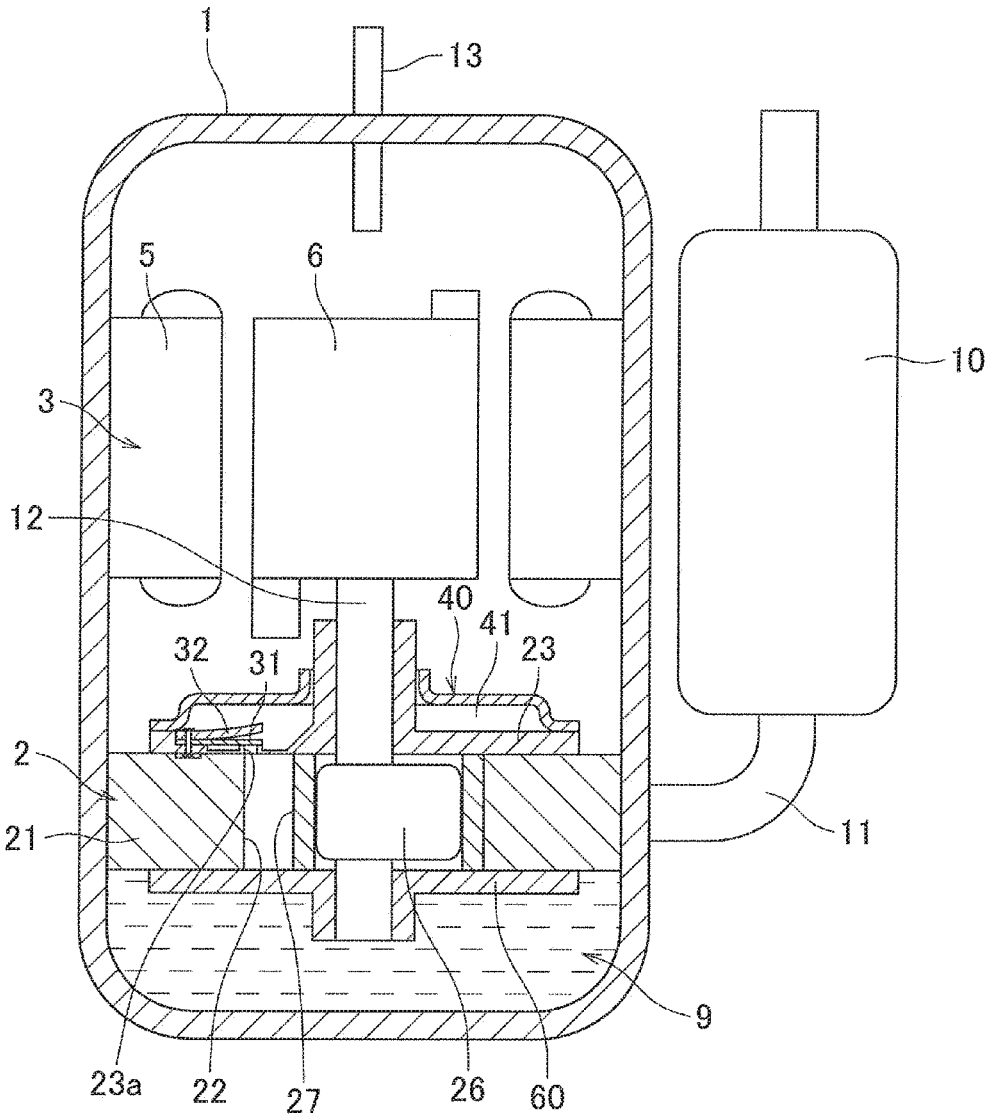
FIG. 1 is a cross section of a compressor of the first embodiment of the present invention.

FIG. 1 is a cross section of a compressor of an embodiment of the present invention. This compressor is a so-called high-pressure dome-shaped rotary compressor. In a casing 1 of the compressor, a compression mechanism 2 is disposed in a lower portion, and a motor 3 is disposed in an upper portion. The compression mechanism 2 is configured to be driven by a rotor 6 of the motor 3 through a drive shaft 12.

The compression mechanism 2 takes in refrigerant from, an accumulator 10 through an intake pipe 11. The refrigerant is obtained by controlling a condenser, an expansion mechanism, and an evaporator (these are not illustrated) as well as the compressor. These members constitute an air conditioner which is an example of a refrigeration system.

The compressor is configured as follows: high-temperature and high-pressure compressed discharge gas is discharged from the compression mechanism 2, with which gas the inside of the casing 1 is filled; and the gas passes through a gap between a stator 5 and the rotor 6 of the motor 3, to cool the motor 3, and then the gas is discharged to the outside through, a discharge pipe 13. Lubricating oil 9 is retained in a portion in the casing 1 which is below a high-pressure area.

Figure 2:
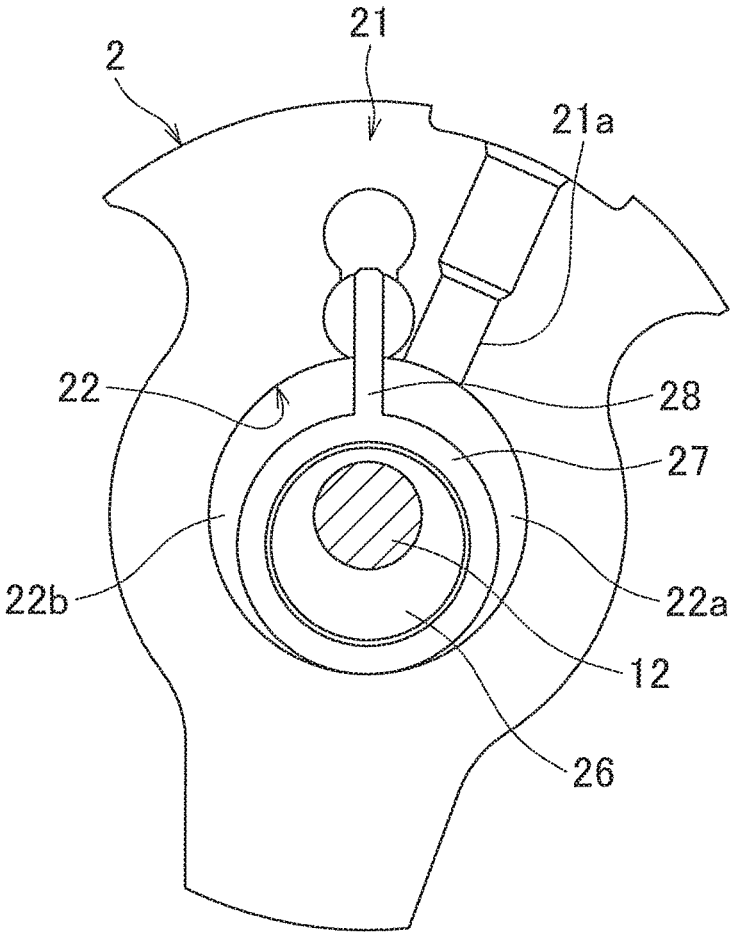
FIG. 2 is a plan view of a cylinder main body of the compressor of FIG. 1.

As shown in FIG. 1 and FIG. 2, the compression mechanism 2 includes: a cylinder main body 21 forming a compression chamber (cylinder chamber) 22; and an upper end surface member 23 and a lower end surface member 60 which are respectively attached to upper and lower end surfaces of the cylinder main body 21 to close the compression chamber 22. The drive shaft 12 penetrates the upper end surface member 23 and the lower end surface member 60 and enters the compression chamber 22. In the compression chamber 22, a roller 27 is disposed so as to be able to revolve. The roller 27 is fitted around a crank pin 26 provided to the drive shaft 12. The revolving motion of the roller 27 creates compression operation.

The inside of the compression chamber 22 is partitioned by a blade 28 provided integrally with the roller 27. Specifically, as shown in FIG. 2, the cylinder main body 21 has a cylinder intake hole 21*a* opening onto an inner surface of the compression chamber 22. Into the compression chamber 22, the refrigerant is supplied through the intake pipe 11 inserted into the cylinder intake hole 21*a*. A right chamber to the right of the blade 28 forms an intake chamber 22*a* to which the cylinder intake hole 21*a* opens. Meanwhile, a left chamber to the left of the blade 28 forms a discharge chamber 22*b*, to which a discharge hole 23*a* shown in FIG. 1 opens. The discharge hole 23*a* opens onto the inner circumferential surface of the compression chamber 22. Semicircular-shaped bushes are respectively in close contact with both surfaces of the blade 28, to provide sealing. Lubrication between the blade 28 and the bushes is provided by the lubricating oil 9.

Now, the operation of the compression mechanism 2 is described. The crank pin 26 rotating with the drive shaft 12 rotates eccentrically, and then the roller 27 fitted around the crank pin 26 revolves with an outer circumferential surface of the roller 27 contacting the inner circumferential surface of the compression chamber 22. As the roller 27 revolves in the compression chamber 22, the blade 28 moves forward and backward with the both side surfaces of the blade 28 being respectively held by the bushes. As a result, low-pressure refrigerant is taken into the intake chamber 22*a* through the intake pipe 11, and the refrigerant is compressed in the discharge chamber 22*b* into high-pressure refrigerant, which is then discharged through the discharge hole 23*a*.

Figure 3:
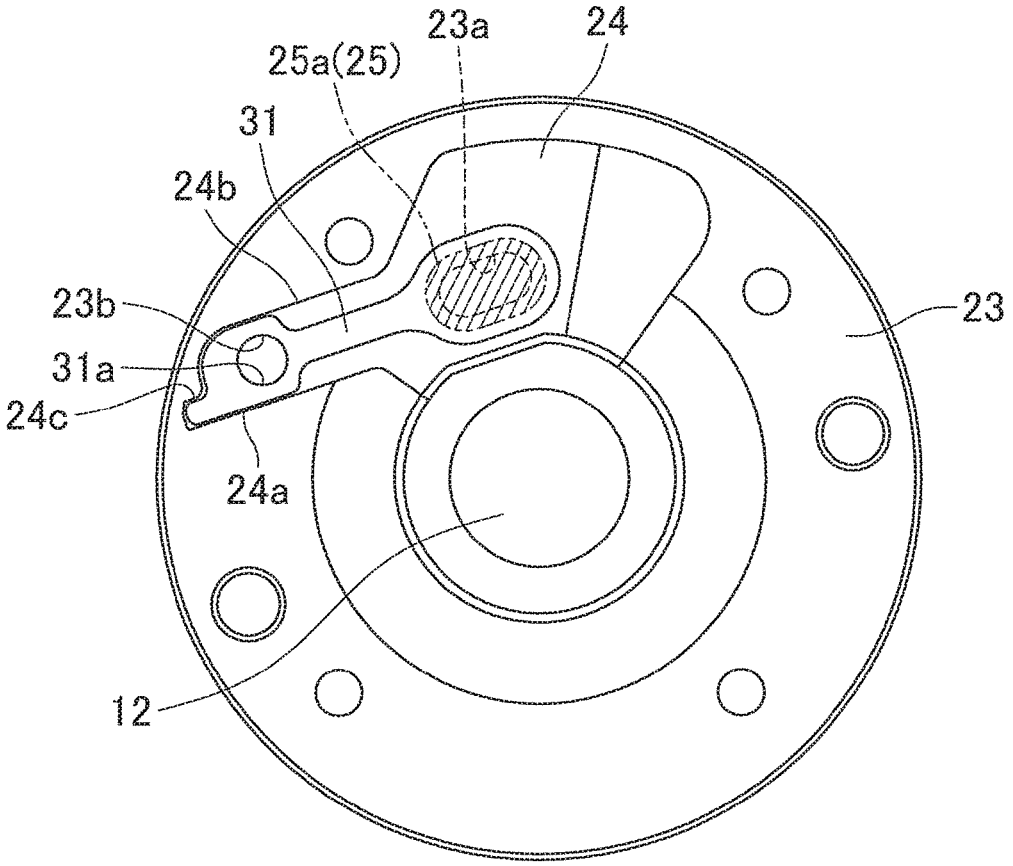
FIG. 3 is a cross section of the compressor of FIG. 1.
Figure 4:
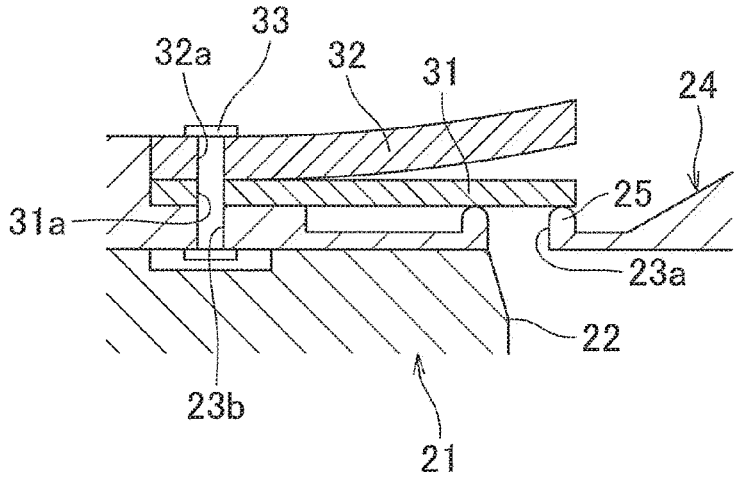
FIG. 4 is an enlarged cross section of a main part of the compressor of FIG. 1.

As shown in FIG. 3 and FIG. 4, on an upper end surface of the end surface member 23, a recess (dent) 24 is provided. In the recess 24 of the end surface member 23, a plate-like discharge valve 31 and a plate-like valve limiting member 32 are provided. Further, in the recess 24 of the end surface member 23, there are the discharge hole 23*a* and a through hole 23*b*. The discharge hole 23*a* communicates with the compression chamber 22 and has an oval shape. The through hole 23*b* is located in the vicinity of the discharge hole 23*a*. Furthermore, in the recess, an annular projection 25 is provided around the discharge hole 23*a*. An upper end portion of the annular projection 25 has a substantially semicircular cross-section, and the annular projection 25 is designed so that a central portion of the projection 25 is the highest. Thus, the central portion of the annular projection 25 is a top portion 25*a* of the annular projection 25. In FIG. 3, some of the members such as the valve limiting member 32 are not illustrated, and the top portion 25*a* of the annular projection 25 is illustrated with a two-dot chain line.

The discharge valve 31 is configured to open/close the annular projection 25 around the discharge hole 23*a*. The valve limiting member 32 cooperates with the end surface member 23 so that the discharge valve 31 is sandwiched between the valve limiting member 32 and the end surface member 23. The discharge valve 31 has a hole 31*a* while the valve limiting member 32 has a hole 32*a*. The holes 31*a* and 32*a* each has a size substantially the same as that of the through hole 23*b*. The recess 24 of the end surface member 23 has a side wall 24*a* and a side wall 24*b* which are substantially opposed to each other. Each of the side walls 24*a* and 24*b* extends from a location near the through hole 23*b* toward the discharge hole 23*a*. The side walls 24*a* and 24*b* of the recess 24 are respectively located on both sides of a portion of the discharge valve 31 and a portion of the valve limiting member 32, each of which portion is around a rivet 33, so as to approximately position these portions.

The discharge valve 31 and the valve limiting member 32 are fixed to the end surface member 23 by the rivet 33. The rivet 33 is inserted into the hole 31*a* of the discharge valve 31 and the hole 32*a* of the valve limiting member 32, and is further inserted into the through hole 23*b* of the end surface member 23, to fix the discharge valve 31 while the discharge valve 31 is sandwiched between the end surface member 23 and the valve limiting member 32.

In a free state, the discharge valve 31 closes the annular projection 25 around the discharge hole 23*a*. Meanwhile, when the pressure of the refrigerant (compressed gas) in the compression chamber 22 reaches a predetermined value, the discharge valve 31 is elastically deformed to separate from the annular projection 25. As a result, the compressed gas is discharged from, the discharge hole 23*a*. The valve limiting member 32 is configured to restrict the movement of the discharge valve 31 so that the discharge valve 31 is not deformed (swung) more than necessary.

To the end surface member 23, a muffler main body 40 is attached so as to cover the discharge valve 31. The muffler main body 40 is fixed to the end surface member 23 by a fixing member such as a bolt. The muffler main body 40 and the end surface member 23 form a muffler chamber (muffler space) 41. The muffler chamber 41 and the cylinder chamber 22 communicate with each other through the discharge hole 23*a*. The muffler main body 40 has a hole which establishes communication between the muffler chamber 41 and a space in the casing 1. As such, the surface of the end surface member 23 on which the recess 24 is formed faces the muffler chamber 41.

Figure 5:
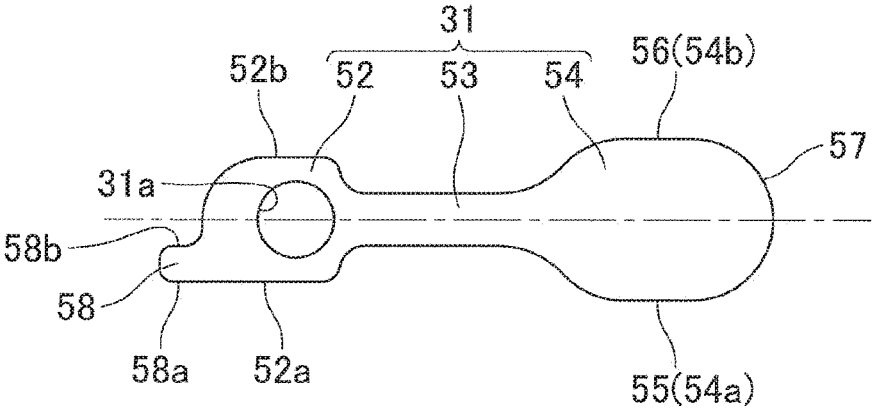
FIG. 5 is a plan view of a discharge valve of the compressor of FIG. 1.

As shown in FIG. 5, the discharge valve 31 includes a fixed portion 52, a flexible portion 53, and a head portion 54. The fixed portion 52 is fixed to the end surface member 23 through the hole 31*a* and the through hole 23*b* of the end surface member 23. The flexible portion 53 extends from the fixed portion 52. The head portion 54 is located on a leading end side of the flexible portion 53 and faces the annular projection 25. The explanation will be given on the premise that the center of the hole 31*a* of the discharge valve 31 is aligned with the center of the through hole 23*b* of the end surface member 23 in FIG. 5.

The fixed portion 52 includes the hole 31*a*. The fixed portion 52 is a portion fixed to the end surface member 23 at a position between the side walls 24*a* and 24*b* of the recess 24. The width of the fixed portion 52 (the width in an up-down direction on the sheet of FIG. 5) is designed to be slightly smaller than the distance between the side walls 24*a* and 24*b* of the recess 24, taking into consideration an assembling error. The fixed portion 52 includes a protruding portion 58 formed at its rear end portion. The protruding portion 58 has a rectangular shape in a plan view. A first side surface 58*a* of the protruding portion 58 is designed to be substantially flush with a side surface 52*a* of the fixed portion 52 which surface is on the side closer to the bearing portion 12. The protruding portion 58 is located in an area of the discharge valve 31 which area is on the side closer to the bearing portion 12 out of areas of the discharge valve 31 divided by the center line of the discharge valve 31 (the protruding portion 58 is located in one of the areas divided by the center line). Thus, as well as the first side surface 58*a*, a second side surface 58*a* of the protruding portion 58 is located in the area on the side closer to the bearing portion 12 relative to the center line of the discharge valve 31. The entire protruding portion 58 is located in the area on the side closer to the bearing portion 12 relative to the center line of the discharge valve 31. A rear end portion of a side surface 52*b* of the fixed portion 52 which surface is on the opposite side from the bearing portion 12 (the side surface 52*b* of the fixed portion 52 which is not designed to be substantially flush with the protruding portion 58) is designed to be curved. Further, as shown in FIG. 3, the recess 24 is outlined along the rear end portion of the fixed portion 52. Thus, a part of a rear end portion of the recess 24 is formed to protrude in the substantially same shape as that of the protruding portion 58. Accordingly, the first side surface 58*a* of the protruding portion 58 faces the side wall 24*a* of the recess 24, and the second side surface 58*b* of the protruding portion 58 faces a side wall 24*c* of the rearwardly protruding part of the recess 24. The width of the protruding portion 58 (the width in the up-down direction on the sheet of FIG. 5) is designed to be slightly smaller than the distance between the side walls 24*a* and 24*c* of the recess 24, taking into consideration an assembling error. As will be described later, when the discharge valve 31 rotates about the hole 31*a* in the recess 24 so that the head portion of the discharge valve 31 moves in a direction away from the bearing portion 12, the side surface 58*a* of the protruding portion 58 of the fixed portion 52 comes into contact with the side wall 24*a* of the recess 24. Meanwhile, when the discharge valve 31 rotates about the hole 31*a* in the recess 24 so that the head portion of the discharge valve 31 moves in a direction toward the bearing portion 12, the side surface 58*b* of the protruding portion 58 of the fixed portion 52 comes into contact with the side wall 24*c* of the recess 24.

The flexible portion 53 is designed to nave a width narrower than that of the fixed portion 52. The flexible portion 53 is configured to be bent and elastically deformed when the pressure of the refrigerant in the compression chamber 22 reaches the predetermined value.

The head portion 54 is designed to have a width wider than that of the flexible portion 53. The head portion 54 is configured to open/close the annular projection 25 around the discharge hole 23*a*. In a plan view, a first side surface 54*a* of the head portion 54 includes a first straight portion 55, and a second side surface 54*b* of the head portion 54 includes a second straight portion 56. Further, in a plan view, a leading end portion 57 of the head portion 54 is designed to be curved.

Figure 6A:
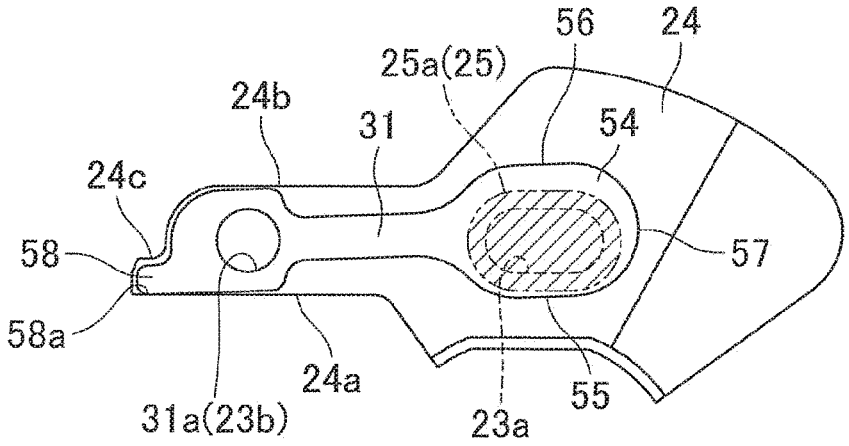
FIG. 6A to FIG. 6C are plan views each showing a state where the discharge valve is fixed in the compressor of FIG. 1.
Figure 6B:
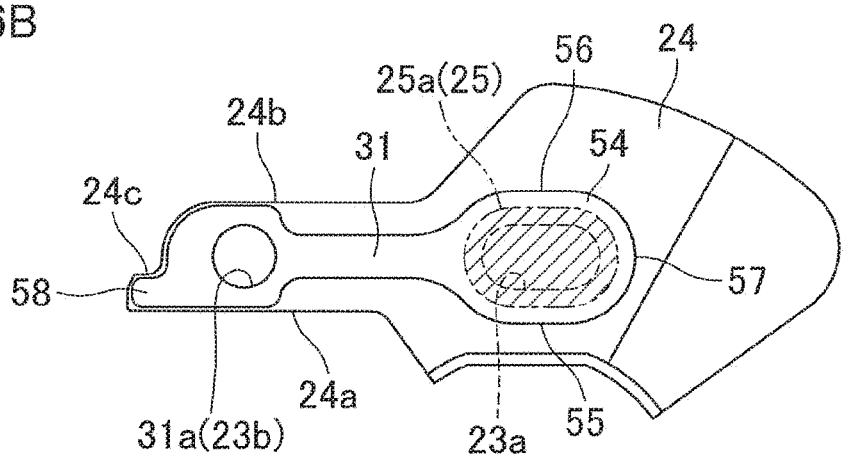
Figure 6C:
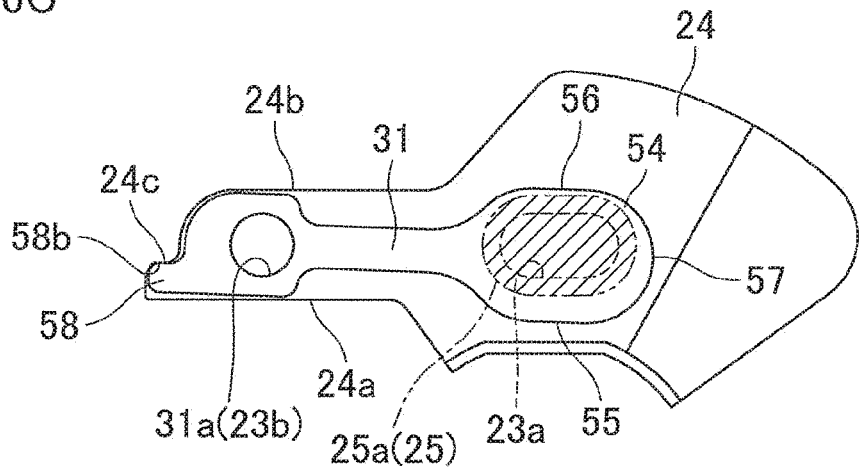

The discharge hole 23*a* is designed to have an oval shape. FIG. 6A to FIG. 6C each shows a state after the discharge valve 31 is disposed in the recess 24 and before fixed to the end surface member 23. In these figures, some members such as the valve limiting member 32 are not illustrated, and a position of the top portion 25*a* of the oval-shaped annular projection 25 is illustrated with a two-dot chain line. As shown in FIG. 6B, it is considered that the discharge valve 31 is properly positioned with respect to the end surface member 23 when the center line of the discharge valve 31 matches a straight line passing through the center of the through hole 23*b* of the end surface member 23 and through the center of the oval-shaped discharge hole 23*a*, in a plan view. If the discharge valve 31 is fixed in this state, the discharge valve 31 is in a properly fixed position (the discharge valve 31 is not shifted). In this position, the head portion 54 is able to properly close the oval-shaped annular projection 25.

In the meantime, as shown in FIG. 6A, in a plan view, when the discharge valve 31 rotates about the hole 31*a* (through hole 23*b*) and the first straight portion 55 of the head portion 54 moves in a direction away from, the drive shaft 12 (when the first straight portion 55 of the head portion 54 moves a predetermined distance toward the center line of the discharge valve 31 from the properly fixed position), the side surface 58*a* of the protruding portion 58 of the fixed portion 52 comes into contact with the side wall 24*a* of the recess 24, and thereby the rotation of the discharge valve 31 is restricted. When the discharge valve 31 is in a position where no more rotation in the above direction is impossible, the first straight portion 55 of the head portion 54 is located outside the annular projection 25. The length of the first straight portion 55 of the head portion 54 is designed to be substantially the same as the length of each straight portion of the top portion 25*a* of the oval-shaped annular projection 25, which straight portion is parallel to the longitudinal direction of the annular projection 25. If the discharge valve 31 is fixed in this state, the discharge valve 31 is not in the properly fixed position, but in a state where the head portion 54 of the discharge valve 31 is shifted in the direction away from the drive shaft 12. However, the head portion 54 is able to properly close the oval-shaped annular projection 25.

Further, as shown in FIG. 6C, in a plan view, when the discharge valve 31 rotates about the hole 31*a* (through hole 23*b*) and the second straight portion 56 of the head portion 54 moves in the direction toward the drive shaft 12 (when the second straight portion 56 of the head portion 54 moves a predetermined distance toward the center line of the discharge valve 31 from the properly fixed position), the side surface 58*b* of the protruding portion 58 of the fixed portion 52 comes into contact with the side wall 24*c* of the recess 24, and thereby the rotation of the discharge valve 31 is restricted. When the discharge valve 31 is in a position where no more rotation in the above direction is impossible, the second straight portion 56 of the head portion 54 is located outside the annular projection 25. The length of the second straight portion 56 of the head portion 54 is designed to be substantially the same as the length of a straight portion of the top portion 25*a* of the oval-shaped annular projection 25, which straight portion is parallel to the longitudinal direction of the annular projection 25. If the discharge valve 31 is fixed, in this state, the discharge valve 31 is not in the properly fixed position, but in a state where the head portion 54 of the discharge valve 31 is shifted in the direction toward the drive shaft 12. However, the head portion 54 is able to properly close the oval-shaped annular projection 25.

Further, it is conceivable that the discharge valve 31 can be shifted from the properly fixed position within a predetermined range between the position shown in FIG. 6A and the position shown in FIG. 6C. Within this range, the leading end portion 57 of the head portion 54 is always located outside a part of the top portion 25*a* of the annular projection 25 which part is farther from, the through hole 23*b*. With this, the head portion 54 is able to properly close the oval-shaped annular projection 25.

Characteristics of Compressor of this Embodiment

In the compressor of this embodiment, the fixed portion 52 includes, at its rear end portion, the protruding portion 58 designed to be flush with the side surface of the fixed portion 52 which, surface is on the side closer to the bearing portion 12. Further, when the discharge valve 31 rotates about the hole 31 in one direction (so that the head portion 54 of the discharge valve 31 moves in the direction away from the bearing portion 12) after the discharge valve 31 is disposed in the recess 24 but before fixed to the end surface member 23, the first side surface 58*a* of the protruding portion 58 comes into contact with the side wall 24*a* of the recess 24. This restricts the discharge valve 31 from rotating and shifting in the one direction. Thus, it is possible to avoid the situation where the head portion 54 of the discharge valve 31 fails to properly close the annular projection 25.

Further, in the compressor of this embodiment, the recess 24 is outlined along the rear end portion of the fixed portion 52. In addition, when the discharge valve 31 rotates about the hole 31 in the other direction (so that the head portion 54 of the discharge valve 31 moves in the direction toward the bearing portion 12) after the discharge valve 31 is disposed in the recess 24 but before fixed to the end surface member 23, the second side surface 58*b* of the protruding portion 58 comes into contact with the side wall 24*c* of the recess 24. This restricts the discharge valve 31 from rotating and shifting in the other direction. Thus, it is possible to avoid the situation where the head portion 54 of the discharge valve 31 fails to properly close the annular projection 25.

Furthermore, in the compressor of this embodiment, the protruding portion 58 is designed to have a rectangular shape. This makes it easier to extend rearward the side surface 52*a* of the discharge valve 31, which surface is on the side closer to the bearing portion 12, and this effectively restricts the discharge valve 31 from rotating and shifting in the other direction.

Moreover, in the compressor of this embodiment, the protruding portion 58 is located in the area of the discharge valve 31 which area is on the side closer to the bearing portion 12 relative to the center line of the discharge valve 31, and therefore the recess 24 can be downsized as compared with the case where the protruding portion 58 is located in an area across the width of the discharge valve 31. With this, in the configuration where the muffler main body 40 is attached to the end surface of the end surface member 23, the area of the end surface of the end surface member 23 sealed by the muffler main body 40 is larger.

Furthermore, in the compressor of this embodiment, the rear end portion of the side surface 52*b* of the fixed portion 52, which surface is on the opposite side from the bearing portion 12, is designed to be curved. Therefore, when the discharge valve 31 rotates in the one direction to be shifted (so that the head portion 54 of the discharge valve 31 moves in the direction away from the bearing portion 12), it is possible to avoid the situation where the side surface 52*b* of the fixed portion 52 of the discharge valve 31, which surface is on the opposite side from the bearing portion 12, comes into contact with the side wall 24*b* of the recess 24 before the side surface 58*a* of the protruding portion 58 of the discharge valve 31, which surface is on the side closer to the bearing portion 12, comes into contact with the side wall 24*a* of the recess 24.

Further, in the compressor of this embodiment, the following advantages are provided. If the discharge hole 23*a* has an oval shape and the lengthwise direction of the discharge valve 31 does not match the longitudinal direction of the discharge hole 23*a*, a twist of the valve may occur at the time of opening/closing of the valve; however, this compressor, while preventing the reliability from being lessened due to such a twist, prevents shifting of the discharge valve 31 even in the case where the length of the flexible portion, which contributes the rigidity of the valve 31, is ensured to some extent, though this shortens the fixed portion 52.

In the compressor of this embodiment, the area of the end surface of the end surface member 23 sealed by the muffler main body 40 is larger, and this prevents leakage of the refrigerant from the muffler space.

Second Embodiment

FIG. 7 shows the second embodiment of this invention. The second embodiment is different from the first embodiment in that: while in the compressor of the first embodiment, the protruding portion 58 of the discharge valve 31 is located at a part of the rear end portion of the discharge valve 31, a protruding portion 158 of a discharge valve 131 is located in a rear end portion of the discharge valve 131 to extend over the entire width thereof in the second embodiment. Along with this, there is a difference in the shape of the recess of the end surface member. The other structures are substantially the same as those of the first embodiment, and therefore, the explanations are omitted.

In a compressor of this embodiment, a recess (dent) 124 is provided on the upper end surface of the end surface member 23. In the recess 124 of the end surface member 23, the plate-like discharge valve 131 and the plate-like valve limiting member 32 are provided. Further, in the recess 124 of the end surface member 23, there are a discharge hole 123*a* and the through hole 23*b*. The discharge hole 123*a* has a circular shape and communicates with the compression chamber 22. The through hole 23*b* is located in the vicinity of the discharge hole 123*a*. Furthermore, in the recess 124, an annular projection 125 is provided around the discharge hole 123*a*. An upper end portion of the annular projection 125 has a substantially semicircular cross-section, and the annular projection 125 is designed so that a central portion of the projection 125 is the highest. Thus, the central portion of the annular projection 125 is a top portion 125*a* of the annular projection 125.

The discharge valve 131 is configured to open/close the annular projection 125 around the discharge hole 123*a*. The discharge valve 131 has a hole 131*a*. The hole 131*a* has a diameter slightly larger than that of the through hole 23*b*. The recess 124 of the end surface member 23 has a side wall 124*a* and side wall 124*b* which are substantially opposed to each other.

The discharge valve 131 includes a fixed portion 152, a flexible portion 153, and a head portion 154. The fixed portion 152 is fixed to the end surface member 23 through the hole 131*a* and the through hole 23*b* of the end surface member 23. The flexible portion 153 extends from, the fixed portion 152. The head portion 154 is located on a leading end side of the flexible portion 153 and faces the annular projection 125.

The fixed portion 152 includes the hole 131*a*. The fixed, portion 152 is a portion fixed to the end surface member 23 at a position between the side walls 124*a* and 124*b* of the recess 124. Further, the width of the fixed portion 152 (the width, in an up-down direction on the sheet of FIG. 7) is designed, to be slightly smaller than the distance between the side walls 124*a* and 124*b* of the recess 124, taking into consideration an assembling error. The fixed portion 152 has a protruding portion 158 formed at its rear end portion. The protruding portion 158 has, in a plan view, an oblique surface (a second side surface 158*b* of the protruding portion 158). The oblique surface extends from a side surface 152*b* of the fixed portion 152, which surface is on the opposite side from the bearing portion 12, toward a side surface 152*a* of the fixed portion 152, which surface is on the side closer to the bearing portion 12, and toward the rear side to form the protruding portion. A first side surface 158*a* of the protruding portion 158 is designed to be substantially flush with the side surface 152*a* of the fixed portion 152 which surface is on the side closer to the bearing portion 12. The protruding portion 158 extends over the entire width of the rear end portion of the discharge valve 131. Further, a rear end portion of the side surface 152*b* of the fixed portion 152 which surface is on the opposite side from the bearing portion 12 is designed to be curved. Furthermore, as shown in FIG. 7, the recess 124 is outlined along the rear end portion of the fixed portion 152. Thus, a part of a rear end portion of the recess 124 is formed to protrude in the substantially same shape as that of the protruding portion 158. Accordingly, the first side surface 158*a* of the protruding portion 158 faces the side wall 124*a* of the recess 124, and the second side surface 158*b* of the protruding portion 158 faces a side wall 124*c* of the rearwardly protruding part of the recess 124. The width of the protruding portion 158 (the width in the up-down direction on the sheet of FIG. 7) is designed to be slightly smaller than the distance between the side walls 124*a* and 124*c* of the recess 124, taking into consideration an assembling error. As will be described later, when the discharge valve 131 rotates about the hole 131*a* in the recess 124 so that the head portion of the discharge valve 131 moves in a direction away from the bearing portion 12, the side surface 158*a* of the protruding portion 158 of the fixed portion 152 comes into contact with the side wall 124*a* of the recess 124. Meanwhile, when the discharge valve 131 rotates about the hole 131*a* in the recess 124 so that the head portion of the discharge valve 131 moves in a direction toward the bearing portion 12, the side surface 158*b* of the protruding portion 158 of the fixed portion 152 comes into contact with the side wall 124*c* of the recess 124.

The flexible portion 153 is designed to have a width narrower than that of the fixed portion 152. The flexible portion 153 is configured to be bent and elastically deformed when the pressure of the refrigerant in the compression chamber 22 reaches a predetermined value.

The head portion 154 is designed to have a width wider than that of the flexible portion 153. The head portion 154 is configured to open/close the annular projection 125 around the discharge hole 123*a*.

Figure 7A:
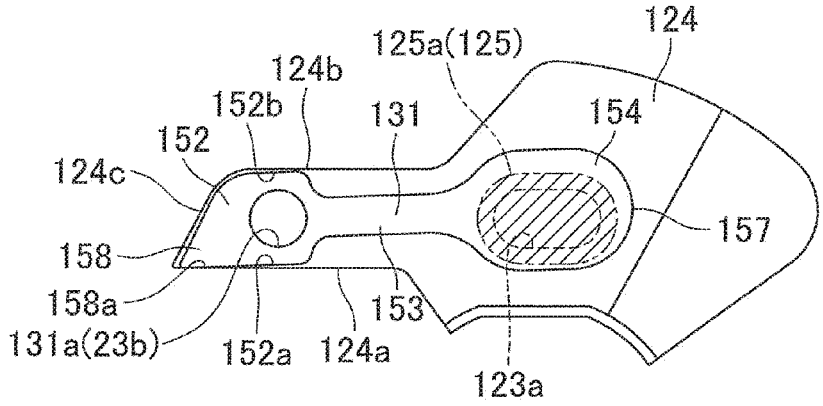
FIG. 7A to FIG. 7C are plan views each showing a state where a discharge valve is fixed in a compressor of the second embodiment of the present invention.
Figure 7B:
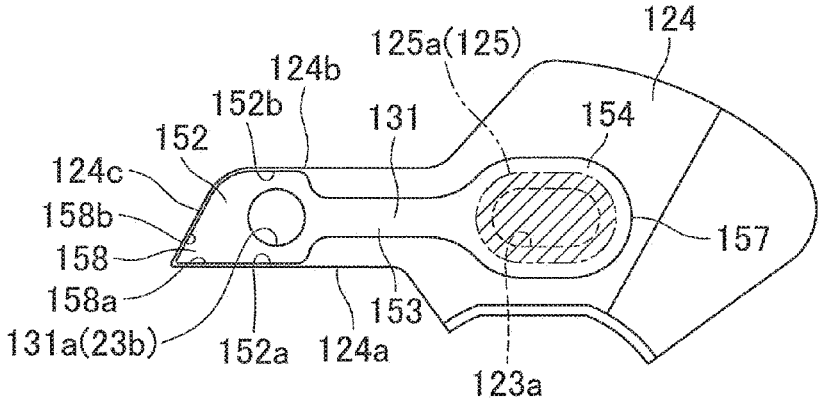
Figure 7C:
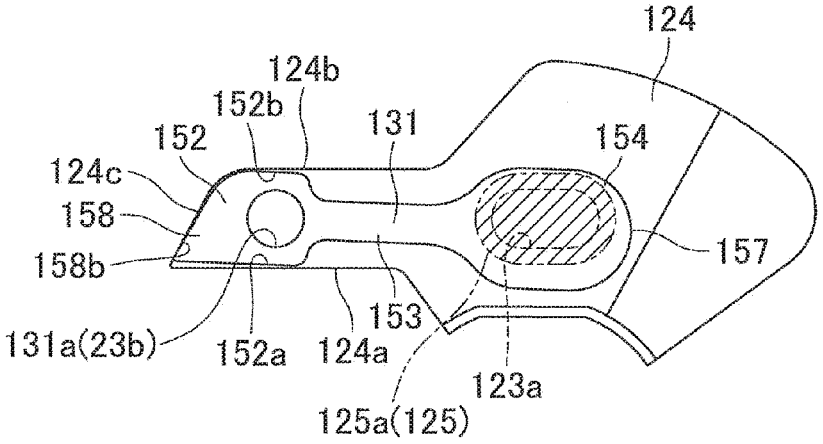

The discharge hole 123*a* is designed to have an oval shape. FIG. 7A to FIG. 7C each snows a state after the discharge valve 131 is disposed in the recess 124 and before fixed to the end surface member 23. In these figures, some members such as the valve limiting member 32 are not illustrated, and a position of the top portion 125*a* of the oval-shaped annular projection 125 is illustrated with a two-dot chain line. As shown in FIG. 7B, it is considered that the discharge valve 131 is properly positioned with respect to the end surface member 23 when the center line of the discharge valve 131 matches a straight line passing through the center of the through hole 23*b* of the end surface member 23 and through the center of the oval-shaped discharge hole 123*a*, in a plan view. If the discharge valve 131 is fixed in this state, the discharge valve 131 is in a properly fixed position (the discharge valve 131 is not shifted). In this position, the head portion 154 is able to properly close the oval-shaped annular projection 125.

In the meantime, as shown in FIG. 7A, in a plan view, when the discharge valve 131 rotates about the hole 131*a* (through hole 23*b*) and the head portion 154 moves in the direction away from the drive shaft 12 (when the head portion 154 moves a predetermined distance toward the center line of the discharge valve 131 from, the properly fixed position), the side surface 158*a* of the protruding portion 158 of the fixed portion 152 comes into contact with the side wall 124*a* of the recess 124, and thereby the rotation of the discharge valve 131 is restricted. If the discharge valve 131 is fixed in the state where the discharge valve 131 cannot rotate any more in the above direction, the discharge valve 131 is not fixed in the properly fixed position, but in the state where the head portion 154 of the discharge valve 131 is shifted in the direction away from the drive shaft 12. However, the head portion 154 is able to properly close the oval-shaped annular projection 125.

In the meantime, as shown in FIG. 7C, in a plan view, when the discharge valve 131 rotates about the hole 131*a* (through hole 23*b*) and the head portion 154 moves in the direction toward the drive shaft 12 (when the head portion 154 moves a predetermined distance toward the center line of the discharge valve 131 from the properly fixed position), the side surface 158*b* of the protruding portion 158 of the fixed portion 152 comes into contact with the side wall 124*c* of the recess 124, and thereby the rotation of the discharge valve 131 is restricted. If the discharge valve 31 is fixed in the state where the discharge valve 131 cannot rotate any more in the above direction, the discharge valve 131 is not in the properly fixed position, but in the state where the head portion 154 of the discharge valve 131 is shifted in the direction toward the drive shaft 12. However, the head portion 154 is able to properly close the oval-shaped annular projection 125.

Further, it is conceivable that the discharge valve 131 can be shifted from the properly fixed position within a predetermined range between the position shown in FIG. 7A and the position shown in FIG. 7C. Within this range, the leading end portion 157 of the head portion 154 is always located outside the top portion 125*a* of the annular projection 125. With this, the head portion 154 is able to properly close the oval-shaped annular projection 125.

Characteristics of Compressor of this Embodiment

The compressor of this embodiment brings about advantageous effects similar to those of the compressor of the first embodiment.

Third Embodiment

Figure 8:
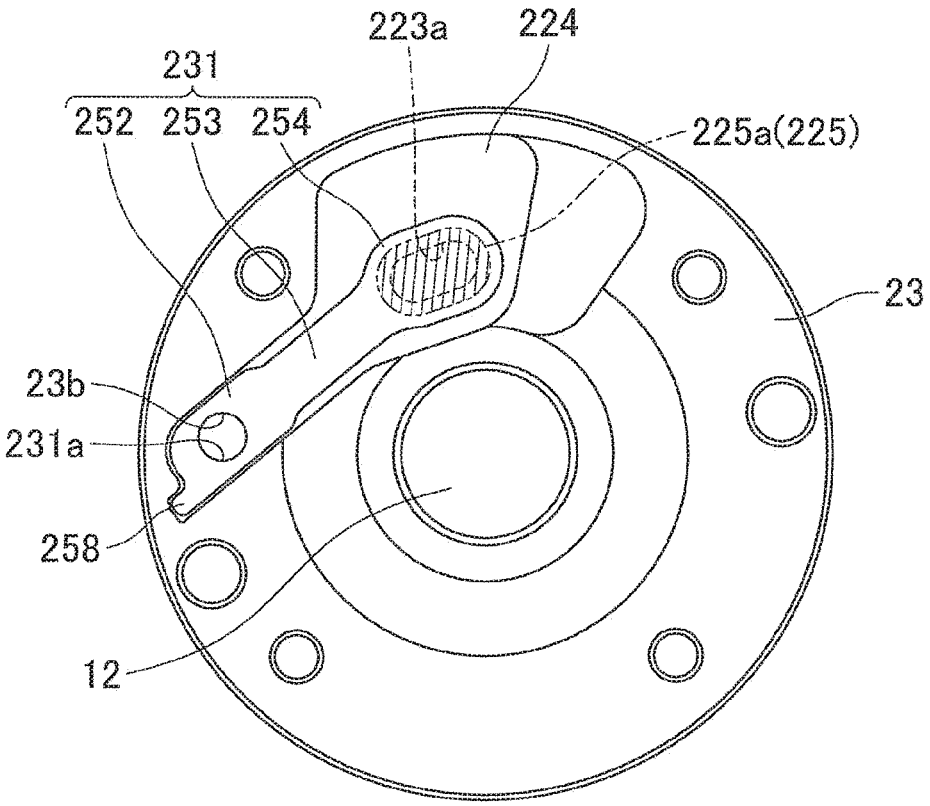
FIG. 8 is a plan view of a cylinder main body of a compressor of the third embodiment of the present invention.

FIG. 8 shows the third embodiment of this invention. The compressor of the third embodiment is different from that of the first embodiment in the location of the oval-shaped discharge hole relative to the drive shaft. Along with this, there is the following difference: while in the first embodiment the head portion 54 of the discharge valve 31 in the recess 24 of the end surface member 23 is not oblique to the flexible portion 53, a head portion 254 of a discharge valve 231 in a recess 224 of the end surface member 23 is oblique to a flexible portion 253 in the third embodiment. The other structures are substantially the same as those of the first embodiment, and therefore, the explanations are omitted.

Although not illustrated, in the same way as in FIG. 6A, in a plan view, when the discharge valve 231 rotates about a hole 231*a* (through hole 23*b*) and the head portion 254 moves in a direction away from the drive shaft 12 (when the head portion 254 moves a predetermined distance toward the center line of the discharge valve 231 from the properly fixed position), a side surface of a protruding portion 258 of a fixed portion 252, which surface is on the side closer to the drive shaft 12, comes into contact with a side wall of the recess 224, and thereby the rotation of the discharge valve 231 is restricted. If the discharge valve 231 is fixed in the state where the discharge valve 231 cannot rotate any more in the above direction, the discharge valve 231 is not in the properly fixed position, but in the state where the head portion 254 of the discharge valve 231 is shifted in the direction away from the drive shaft 12. However, the head portion 254 is able to properly close an annular projection 225 (top portion 225*a*) around the oval-shaped discharge hole 223*a*.

Further, in the same way as in FIG. 6C, in a plan view, when the discharge valve 231 rotates about the hole 231*a* (through hole 23*b*) and the head portion 254 moves in a direction toward the drive shaft 12 (when the head portion 254 moves a predetermined distance toward the center line of the discharge valve 231 from the properly fixed position), a side surface of the protruding portion 258 of the fixed portion 252, which surface is on the opposite side from, the drive shaft 12, comes into contact with a side wall of the recess 224, and thereby the rotation of the discharge valve 231 is restricted. If the discharge valve 231 is fixed in the state where the discharge valve 231 cannot rotate any more in the above direction, the discharge valve 231 is not in the properly fixed position, but in the state where the head portion 254 of the discharge valve 231 is shifted in the direction toward the drive shaft 12. However, the head portion 254 is able to properly close the oval-shaped annular projection 225.

Characteristics of Compressor of this Embodiment

The compressor of this embodiment brings about advantageous effects similar to those of the compressor of the first embodiment.

Fourth Embodiment

Figure 9:
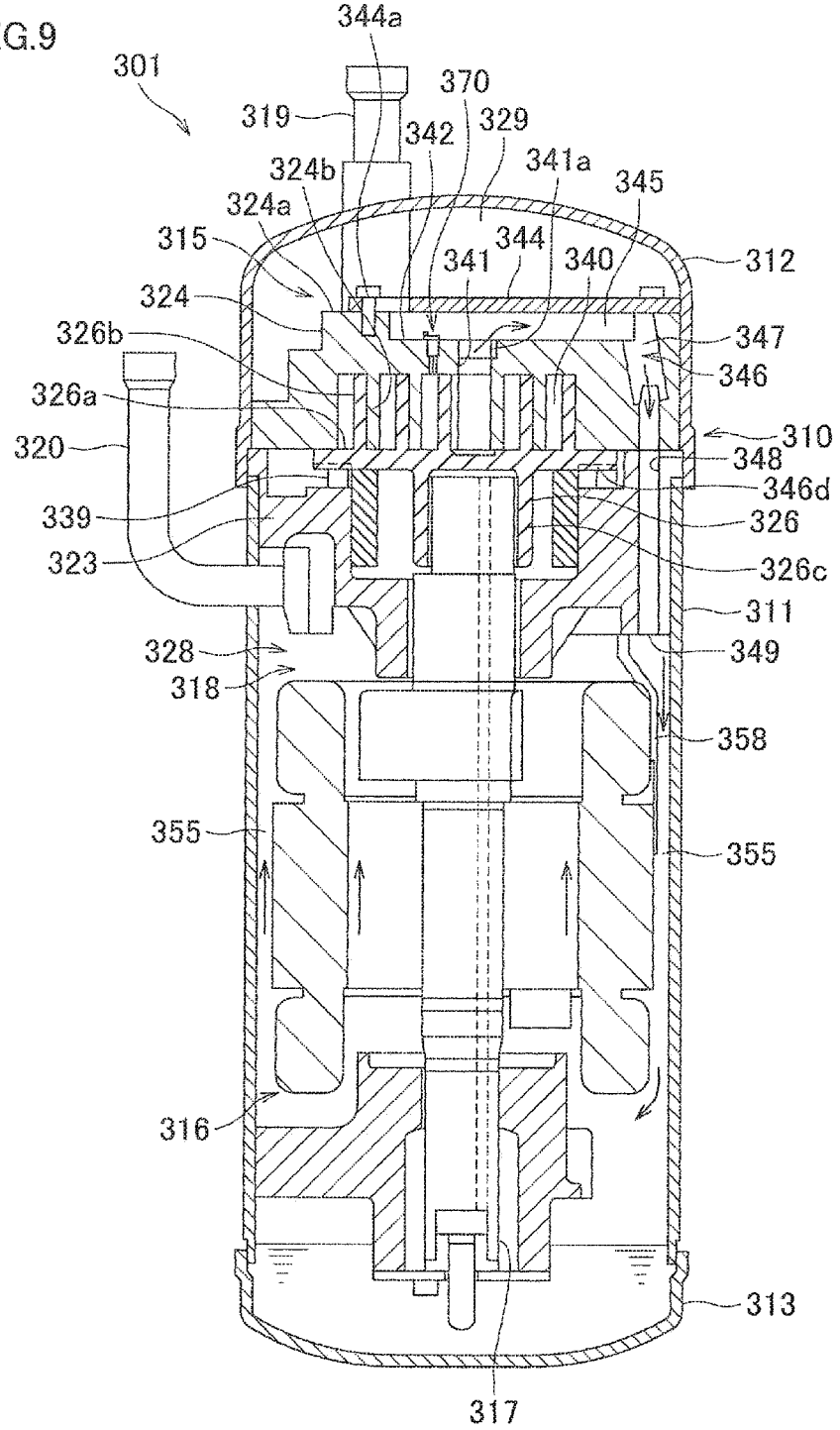
FIG. 9 is a cross section of a scroll compressor of the fourth embodiment of the present invention.

FIG. 9 shows the fourth embodiment of this invention. In the first embodiment, description has been given of the rotary compressor in which the present invention is applied. Now, in this embodiment, description will be given of a scroll compressor in which the present invention is applied.

A scroll compressor 301 shown in FIG. 9 is a high-low pressure dome-type scroll compressor. The compressor structures a refrigerant circuit with an evaporator, a condenser, an expansion mechanism. The compressor functions to compress gas refrigerant in the refrigerant circuit. The compressor is mainly structured by: a closed dome-type casing 310 having an elongated cylindrical shape; a scroll compression mechanism 315; an Oldham ring 339; a drive motor 316; an intake pipe 319; and a discharge pipe 320.

The casing 310 includes: a substantially cylindrical casing body 311; a bowl-like top wall portion 312 tightly welded to an upper end portion of the casing body 311; and a bowl-like bottom wall portion 313 tightly welded to a lower end portion of the casing body 311. The casing 310 mainly accommodates the scroll compression mechanism 315 and the drive motor 316. The scroll compression mechanism 315 is configured to compress the gas refrigerant. The drive motor 316 is disposed below the scroll compression mechanism 315. The scroll compression mechanism 315 and the drive motor 316 are coupled to each other by a drive shaft 317 disposed so as to extend in an up-down direction in the casing 310. As a result, a gap space 318 is created between the scroll compression mechanism 315 and the drive motor 316.

As shown in FIG. 9, the scroll compression mechanism 315 is mainly structured by: a housing 323; a fixed scroll 324 disposed on top of and in close contact with the housing 323; and a movable scroll 326 which meshes with the fixed scroll 324.

The fixed scroll 324 is mainly structured by: a flat-plate-like end plate 324*a*; and a spiral (or involute) wrap 324*b* formed on an under surface of the end plate 324*a*.

The end plate 324*a* has a discharge hole 341 formed through the substantial center of the end plate 324*a*. The discharge hole 341 communicates with a compression chamber 340 which will be described later. The discharge hole 341 is formed to extend in the up-down direction at a central portion of the end plate 324*a*. The shape of the opening the discharge hole 341 on the surface is non-circular to increase its opening area to reduce a loss of discharge pressure. Further, on a top surface of the end plate 324*a*, a counterbore space 341*a* communicating with the discharge hole 341 is formed. Furthermore, on the top surface of the end plate 324*a*, there is formed a large recess 342 which communicates with the discharge hole 341 and the counterbore space 341*a*. The large recess 342 is a recess extending in a horizontal direction on the top surface of the end plate 324*a*. To the top surface of the fixed scroll 324, a lid 344 is fastened by a bolt so as to close the large recess 342. The large recess 342 is thus covered with the lid 344, and this forms a muffler space 345, which is an expansion chamber functions to muffle noise of the scroll compression mechanism 315 in operation. The fixed scroll 324 and the lid 344 are closely secured to each other via not-shown packing for airtight sealing.

Figure 10:
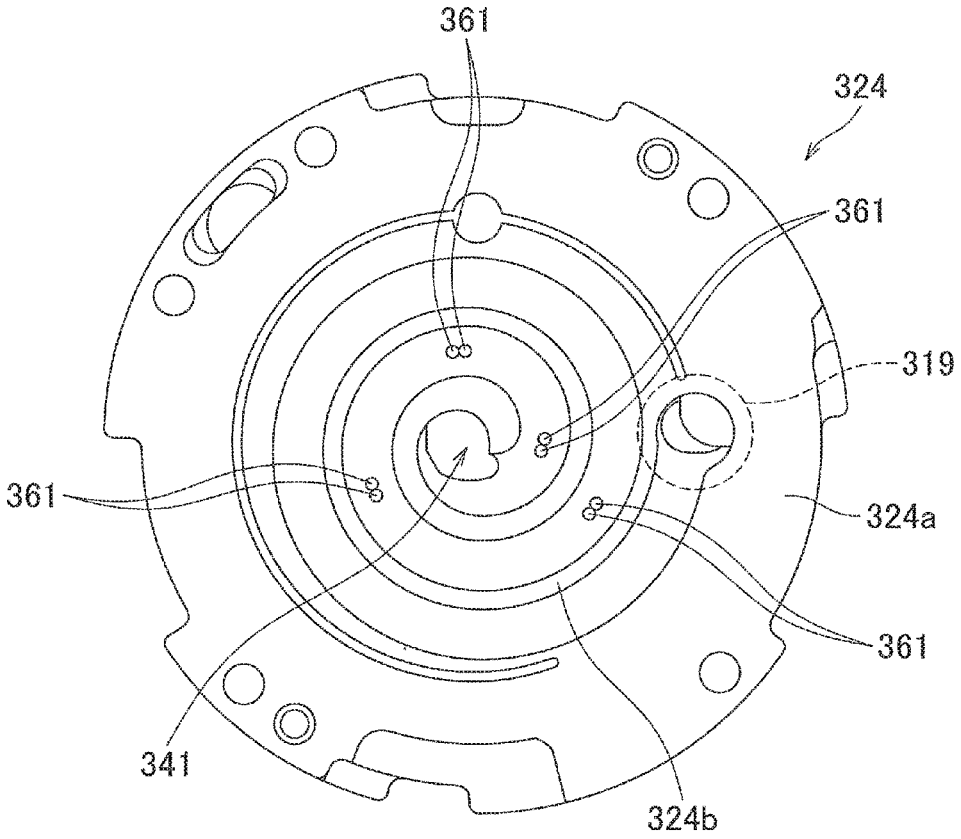
FIG. 10 is a view of a fixed scroll included in FIG. 9, viewed from below.

As shown in FIG. 10, the end plate 324*a* of the fixed scroll 324 has 4 pairs of circular relief holes 361, each formed through the end plate 324*a*. To be more specific, the relief holes 361 are arranged so that the compression chamber 340 passes the 4 pairs of relief holes 361 in each compression cycle from intake to discharge.

As shown in FIG. 10, each relief hole 361 is formed at a position which does not correspond to the wrap 324*b* of the fixed scroll 324.

Figure 13:
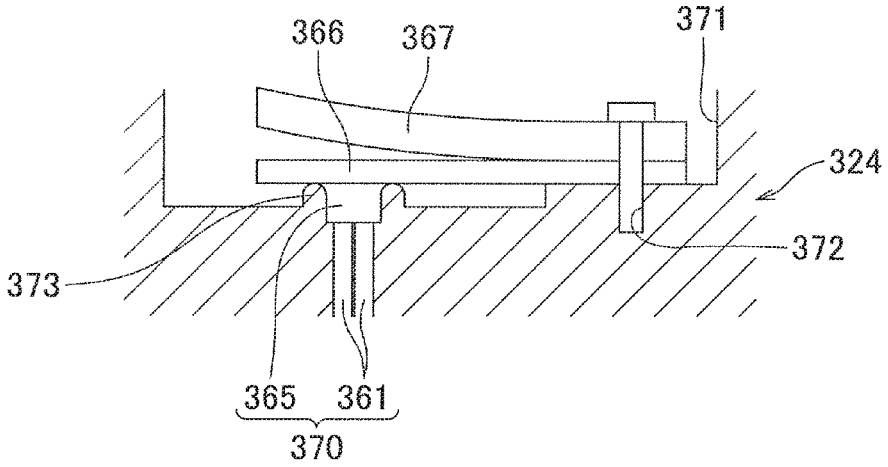
FIG. 13 is an enlarged cross section of the main part of the compressor of FIG. 9.

Further, as shown in FIG. 13, on a back side of the end plate 324*a* (near the top surface), there are formed counterbore holes 365 each communicating with a corresponding pair of the relief holes 361. As shown in FIG. 6, each pair of relief holes 361 and the corresponding counterbore hole 365 form a relief passage 370 penetrating the end plate 324*a* of the fixed scroll 324.

Further, as shown in FIG. 13, on an inner surface of the large recess 342 on the top surface of the end plate 324*a* of the fixed scroll 324, there are provided relief valves 366 and relief valve limiters 367. Each relief valve 366 is a check valve closing the corresponding counterbore hole 365. The relief valve limiter 367 is configured to limit the degree of opening of the corresponding relief valve 366 within a predetermined range.

As shown in FIG. 9, the movable scroll 326 is mainly structured by: an end plate 326*a*; a spiral (or involute) wrap 326*b* formed on a top surface of the end plate 326*a*; a bearing portion 326*c* formed on an under surface of the end plate 326*a*; and groove portions 326*d* formed at opposed end portions of the end plate 326*a*.

The movable scroll 326 is of an outer drive type. That is, the movable scroll 326 includes the bearing portion 326*c* which is fitted around the drive shaft 317.

The Oldham ring 339 is fitted in the groove portions 326*d* of the movable scroll 326. With this, the movable scroll 326 is supported by the housing 323. Further, an upper end of the drive shaft 317 is fitted in the bearing portion 326*c*. The movable scroll 326 is incorporated in the scroll compression mechanism 315 in this way, and thereby, the movable scroll 326 revolves in the housing 323 without rotating with the rotation of the drive shaft 317. The wrap 326*b* of the movable scroll 326 meshes with the wrap 324*b* of the fixed scroll 324. Between contact portions of the wraps 324*b* and 326*b*, the compression chamber 340 is created. In the compression chamber 340, the volume of the space between the wraps 324*b* and 326*b* decreases toward the center as the movable scroll 326 revolves. The scroll compressor 301 of this embodiment is configured to compress the gas refrigerant in this way.

The scroll compression mechanism 315 includes a communication passage 346 formed through the fixed scroll 324 and the housing 323. The communication passage 346 is formed of a scroll-side passage 347 and a housing-side passage 348 communicating with each other. The scroll-side passage 347 is formed through the fixed scroll 324. The housing-side passage 348 is formed by notching a part of the housing 323. An upper end of the communication passage 346 opens onto the large recess 342. A lower end of the communication passage 346, i.e., a lower end of the housing-side passage 348, opens onto a lower end surface of the housing 323. That is, the lower end opening of the housing-side passage 348 structures a discharge hole 349 through which the refrigerant in the communication passage 346 is discharged to the gap space 318.

Through the intake pipe 319, the refrigerant in the refrigerant circuit is introduced into the scroll compression mechanism 315. The intake pipe 319 is hermetically fitted into the top wall portion 312 of the casing 310. The intake pipe 319 penetrates a low-pressure space 329 in the up-down direction, and an inner end portion of the intake pipe 319 is fitted into the fixed scroll 324.

Through the discharge pipe 320, the refrigerant in the casing 310 is discharged to the outside of the casing 310. The discharge pipe 320 is hermetically fitted in the casing body 311 of the casing 310. The discharge pipe 320 protrudes through an inner surface of the casing body toward the center, and a lower end of the discharge pipe 320 opens to communicate with the gap space 318 which is a high-pressure space 328.

The following will briefly describe an operation of the scroll compressor 301, with reference to FIG. 9. First of all, when the drive motor 316 is driven, the drive shaft 317 rotates, and the movable scroll 326 performs revolving motion instead of rotating motion. Then, low-pressure gas refrigerant is taken into the compression chamber 340 through the intake pipe 19 and the periphery of the compression chamber 340. The gas refrigerant is compressed as the volume of the compression chamber 340 changes, into high-pressure gas refrigerant. The high-pressure gas refrigerant is discharged, from a central portion of the compression chamber 340 to the muffler space 345 through the discharge hole 341 and the counterbore space 341*a*. When excessively compressed gas is generated in the compression chamber 340 (when the inner pressure of the compression chamber 340 exceeds a valve-closing pressure of the relief valves 366), the excessively compressed gas is discharged to the muffler space 345 through the relief passages 370. Thereafter, the gas flows through the communication passage 346 (i.e., the scroll-side passage 347 and the housing-side passage 348) and the discharge hole 349 to the gap space 318. Then, the gas flows downward between a guide plate 358 and the inner surface of the casing body 311. When the gas refrigerant flows downward between the guide plate 358 and the inner surface of the casing body 311, a branch of the flow of the gas refrigerant flows between the guide plate 358 and the drive motor 316 in a circumferential direction, and lubricating oil contained in the gas refrigerant is separated. Meanwhile, another branch of the gas refrigerant flows downward through a portion of a motor cooling passage 355 to an under-motor space, and then the gas flow is reversed. The refrigerant flows upward through an air gap passage between a stator and a rotor, or through another portion of the motor cooling passage 355 which is on the opposite side from the communication passage 346 (at the left in FIG. 9). Then, the branch of the gas refrigerant having passed on the guide plate 358 and the branch of the gas refrigerant having passed through the air gap passage or the motor cooling passage 355 join together at the gap space 318, and then the gas refrigerant is discharged to the outside of the casing 310 through the discharge pipe 320. Then, the gas refrigerant discharged to the outside of the casing 310 circulates through the refrigerant circuit. Thereafter, the gas refrigerant is taken into the scroll compression mechanism 315 again through the intake pipe 319, to be compressed.

Figure 11:
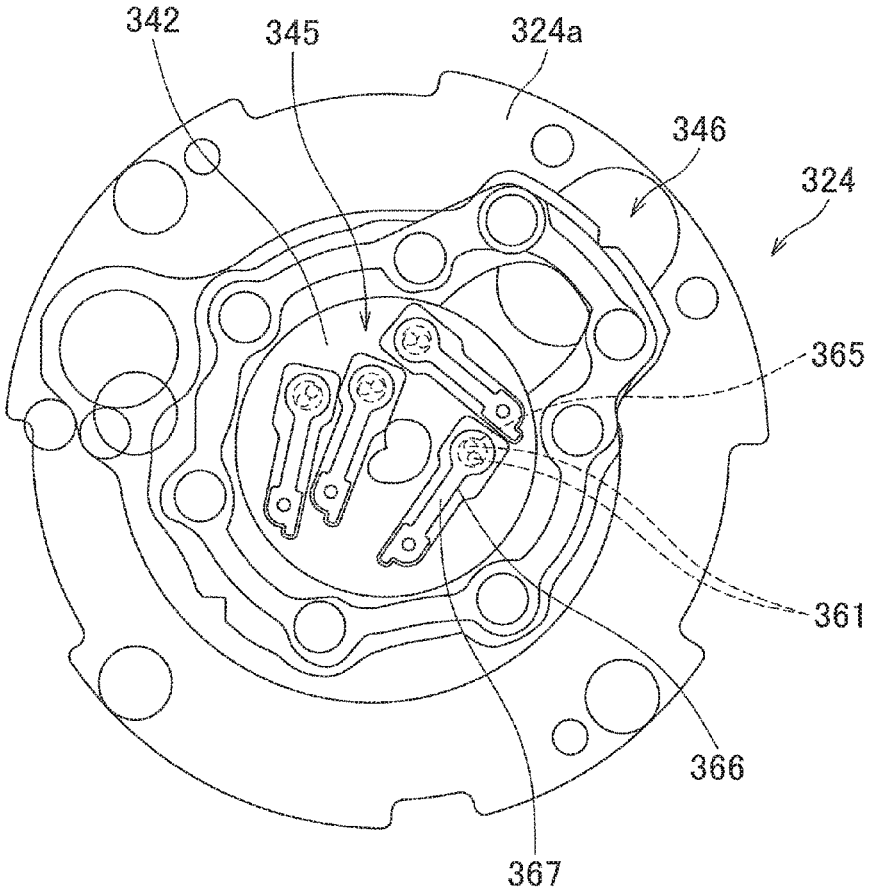
FIG. 11 is a diagram showing a state where a lid on the top of the fixed scroll in FIG. 9 is removed.
Figure 12:
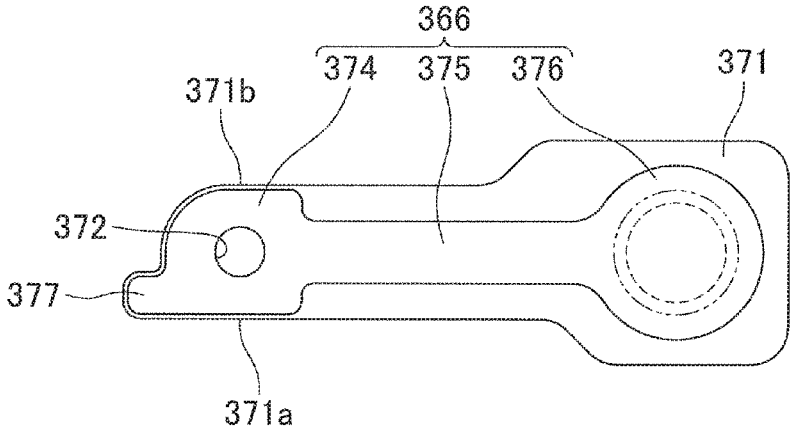
FIG. 12 is an enlarged plan view of a main part of the compressor of FIG. 9.

In the scroll compressor of this embodiment, recesses (dents) 371 are provided on an upper end surface of the fixed scroll 324, as shown in FIG. 11 to FIG. 13. On the upper end surface of the fixed scroll 324, there are four recesses 371. Because the recesses 371 have the same structure, description will be given for one of the recesses 371 with reference to FIG. 12 and FIG. 13, and the description of the remaining recesses 371 is omitted. In the recess 371 of the fixed scroll 324, a plate-like relief valve 366 and a plate-like relief valve limiter 367 are provided. Further, in the recess 371 of the fixed scroll 324, a circular counterbore space 365 and a through hole 372 are provided. The counterbore space 365 communicates with the compression chamber 340. The through hole 372 is located in the vicinity of the counterbore space 365. In the recess, an annular projection 373 is provided around the counterbore space 365.

The relief valve 366 is configured to open/close the annular projection 373 around the counterbore space 365. The relief valve limiter 367 cooperates with the fixed scroll 324 so that the relief valve 366 is sandwiched between the relief valve limiter 367 and the fixed scroll 324. The recess 371 of the fixed scroll 324 has a side wall 371*a* and side wall 371*b* which are substantially opposed to each other. Each of the side walls 371*a* and 371*b* extends from a location near the through hole 372 toward the counterbore space 365. The side walls 371*a* and 371*b* of the recess 371 are respectively located on both sides of a portion of the relief valve 366 and a portion of the relief valve limiter 367 so as to approximately position these portions.

In a free state, the relief valve 366 closes the annular projection 373 around the counterbore space 365. When the pressure of the refrigerant (compressed gas) in the compression chamber 340 reaches a predetermined value, the relief valve 366 is elastically deformed to separate from, the annular projection 373. As a result, the compressed gas is discharged through the counterbore space 365.

As shown in FIG. 13, the relief valve 366 is fixed to the fixed scroll 324 via the through hole 372*b*. The relief valve 366 includes a fixed portion 374, a flexible portion 375, and a head portion 376. The flexible portion 375 extends from the fixed, portion 374. The head portion 376 is located on a leading end side of the flexible portion 375 and faces the annular projection 373. The fixed portion 374 has a protruding portion 377 formed at its rear end portion. The protruding portion 377 is designed to have a substantially rectangular shape in a plan view. A first, side surface 377*a* of the protruding portion 377 is designed to be substantially flush with a side surface of the fixed portion 374 which surface is on the side closer to the center of the fixed scroll 324. The protruding portion 377 is located in an area of the relief valve 366 which area is on the side closer to the center of the fixed scroll 324 out of areas of the relief valve 366 divided by the center line of the relief valve 366 (the protruding portion 377 is located in one of the areas divided by the center line). A rear end portion of a side surface of the fixed portion 374 which surface is on the opposite side from the center of the fixed scroll 324 (a side surface of the fixed portion 374 which is not designed to be substantially flush with the protruding portion 377) is designed to be curved.

Similarly to the first to third embodiments, if the relief valve 366 rotates about the through hole 372*b* so that the head portion 376 of the relief valve 366 moves in a direction toward or away from the center of the compression chamber 340 in the recess 373 at the time when the relief valve 366 is fixed through the through hole 372*b* of the fixed scroll 324, the side surface of the protruding portion 377 of the fixed portion 374 comes into contact with the side wall of the recess 371. With this, further shifting is prevented.

Characteristics of Compressor of this Embodiment

The compressor of this embodiment brings about advantageous effects similar to those of the compressor of the first embodiment. Generally, in scroll compressors, a demand for design focusing on a low compression ratio has been increasing to improve annual efficiency. For example, two relief valves used to be disposed; however, there is recently a case where four relief valves are disposed as in this embodiment. In this case, the arrangement of the recesses on the fixed scroll and the length of the fixed portion of each relief valve of the reed valve type are constrained by the diameter size of the fixed scroll, and this may cause a shift of the relief valve. Even in this case, the shift of the relief valve is restricted, which makes it possible to properly close a relief port.

Thus, the embodiments of the present invention are described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

The above-described first to third embodiments each deals with the following case: when the discharge valve rotates about the hole so that the head portion of the discharge valve moves in the direction toward the bearing portion after the discharge valve is disposed in the recess and before fixed to the end surface member, the first side surface of the protrusion comes into contact with the side wall of the recess. However, when the discharge valve rotates about the hole so that the head portion of the discharge valve moves in the direction away from the bearing portion after the discharge valve is disposed in the recess and before fixed to the end surface member, the first side surface of the protrusion may come into contact with the side wall of the recess. The same goes to the fourth embodiment.

The above-described first to third embodiments each deals with the following case: the recess is outlined along the rear end portion of the fixed portion; and when the discharge valve rotates about the hole so that the head portion of the discharge valve moves in the direction toward the bearing portion after the discharge valve is disposed in the recess and before fixed to the end surface member, the second side surface of the protrusion comes into contact with the side wall of the recess. The following structure is also possible: the recess is not outlined along the rear end portion of the fixed portion; and when the discharge valve rotates about the hole so that the head portion of the discharge valve moves in the direction toward the bearing portion after the discharge valve is disposed in the recess and before fixed to the end surface member, the second side surface of the protrusion does not come into contact with the side wall of the recess. The same goes to the fourth embodiment.

In the above-described first to third embodiments, there are described: a case where the protruding portion has a rectangular shape in a plan view; and a case where the rear end of the protruding portion is designed to be oblique. However, the shape of the protruding portion may be changed freely. In the case where the protruding portion has a rectangular shape, the whole of the protruding portion does not have to be located in the area on the side closer to the bearing portion relative to the center line of the discharge valve. A part of the protruding portion may be located in the area on the opposite side from the bearing portion relative to the center line of the discharge valve. The same goes to the fourth embodiment.

While the above-described first to third embodiments each deals with the case where the whole of the first side surface of the protruding portion is designed to be substantially flush with the side surface of the fixed portion which surface is on the side closer to the bearing portion, the present invention is not limited to this. Even in the case where: there is a dent at a part of the first side surface of the protruding portion which part is on the leading end side relative to the rear end; and the whole of the first side surface of the protruding portion is not designed to be substantially flush with the bearing-side side surface of the fixed portion (the surface on the side closer to the bearing portion), the advantageous effects of the present invention are brought about as long as at least the rear end of the first side surface of the protruding portion is substantially on the plane obtained by extending the bearing-side side surface of the fixed portion. The same goes to the fourth embodiment.

In the above-described first to third embodiments, the rear end portion of the side surface of the fixed portion which surface is on the opposite side from the bearing portion is designed to be curved, in a plan view. However, the rear end portion of the side surface of the fixed portion which surface is on the opposite side from the bearing portion may be designed to be perpendicular to the side surface of the fixed portion. The same goes to the fourth embodiment.

The above-described first to third embodiments each deals with the case where the discharge hole has the oval shape. However, the discharge hole may have a circular shape. The shape of the discharge hole is changeable. The same goes to the fourth embodiment.

While in the above-described first to third embodiments, the discharge valve is fixed to the end surface member by the rivet in the through hole functioning as a fixation hole. However, the discharge valve may be fixed to the end surface member by a fixation bolt. In this case, as the fixation hole, a threaded hole in the end surface member may be provided. The threaded hole may be a through hole, or a hole not penetrating the end surface member. The same goes to the fourth embodiment.

In the above-described first to third embodiments, the upper end portion of the annular projection has a substantially semicircular cross-section, and central portion of the projection is the highest. However, the upper end portion of the annular projection may be flat and level. In this case, the entire upper end portion of the annular projection is the top portion of the annular projection. The same goes to the fourth embodiment.

Further, the above-described first to third embodiments each deals with the case where the first side surface of the protruding portion is designed to be substantially flush with the side surface of the fixed portion which surface is on the side closer to the bearing portion. However, the first side surface of the protruding portion may be designed to be substantially flush with the side surface of the fixed portion, which surface is on the opposite side from the bearing portion. Further, the above-described fourth embodiment deals with the case where the first side surface of the protruding portion is designed to be substantially flush with the side surface of the fixed portion which surface is closer to the center of the fixed scroll, in each of the four relief valves. However, in at least one of the four relief valves, the first side surface of the protruding portion may be designed to be substantially flush with the side surface of the fixed portion, which surface is on the opposite side from the center of the fixed scroll.

The above-described fourth embodiment deals with the case where the present invention is applied to the scroll compressor including the relief valves and the recess in which the relief valves are disposed. However, the present invention may be applied to a scroll compressor including one or more discharge valves and a recess in which the discharge valves are disposed. For example, the present invention is applicable to a compressor similar to the scroll compressor of FIG. 9, in which: the discharge hole 341 communicating with the compression chamber 340 is formed to penetrate the substantial center of the end plate 324*a*; a recess is provided around the discharge hole 341 of the end plate 324*a*; and a discharge valve of a reed valve type is disposed in the recess. With reference to the scroll compressor of FIG. 9, there has been described the case where the present invention is applied to all the four relief valves and the recesses in which the relief valves are disposed. However, the present invention may be applied to at least one of the four relief valves and the recess in which the at least one relief valve is disposed. Further, the number of the relief valves may be changed, for example, to 1 or 2. Such a scroll compressor may include one or more relief valves without any discharge valve, or may include one or more discharge valves without any relief valve. Alternatively, such a scroll compressor may include one or more relief valves and one or more discharge valves.

INDUSTRIAL APPLICABILITY

With the present invention, shifting of the discharge valve due to assembling backlash is restricted.

What is claimed is:

1. A compressor comprising:

a member disposed in proximity to a compression chamber and including a recess in which a reed discharge valve is disposed, the recess being on a surface of the member on an opposite side from the compression chamber, the recess being provided with a discharge hole communicating with the compression chamber, a fixation hole used to fix the discharge valve, and an annular projection formed around the discharge hole;

the discharge valve including a fixed portion fixed to the member through the fixation hole, a flexible portion extending from the fixed portion, and a head portion located on a leading end side of the flexible portion and configured to open/close the annular projection, the fixed portion including a protruding portion protruding, in a lengthwise direction of the discharge valve, with respect to a rear end portion of the fixed portion, a first side surface of the protruding portion being designed to be substantially flush with an inner side surface of the fixed portion, the inner side surface of the fixed portion being closer to a center of the member than an outer side surface of the fixed portion; and when the discharge valve rotates in a predetermined direction about the fixation hole after the discharge valve is disposed in the recess but before being fixed to the member, the first side surface of the protruding portion comes into contact with a side wall of the recess.

2. The compressor according to claim 1, wherein the protruding portion has a rectangular shape in a plan view.

3. The compressor according to claim 1, wherein the protruding portion is located in one of two areas of the discharge valve divided by a center line of the discharge valve.

4. The compressor according to claim 1, wherein a rear end of the outer side surface of the fixed portion is designed to be curved in a plan view, the outer side surface of the fixed portion being not substantially flush with the protruding portion.

5. The compressor according to claim 1, wherein:

the discharge hole has an oval shape; and a lengthwise direction of the discharge valve matches a longitudinal direction of the discharge hole.

6. The compressor according to claim 1, wherein the surface of the member on which the recess is formed faces a muffler space.

7. The compressor according to claim 1, wherein the recess is outlined along the rear end portion of the fixed portion; and when the discharge valve rotates in a direction opposite to the predetermined direction about the fixation hole after the discharge valve is disposed in the recess but before being fixed to the member, a second side surface of the protruding portion comes into contact with the side wall of the recess.

8. The compressor according to claim 7, wherein the protruding portion has a rectangular shape in a plan view.

* * * * *